US005836799A

United States Patent [19]

Levine et al.

[11] Patent Number: 5,836,799

[45] Date of Patent: Nov. 17, 1998

[54] SELF-ALIGNED METHOD OF MICRO-MACHINING FIELD EMISSION DISPLAY MICROTIPS

[75] Inventors: Jules D. Levine, Dallas; Kenneth G. Vickers, Whitesboro, both of Tex.

[73] Assignee: Texas Instruments Incorporated, Dallas, Tex.

[21] Appl. No.: 761,587

[22] Filed: Dec. 6, 1996

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 3,755,704 | 8/1973 | Spindt et al. | 313/309 |
| 4,857,161 | 8/1989 | Borel et al. | 204/192.26 |
| 4,857,799 | 8/1989 | Spindt et al. | 313/495 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,775,968 | 7/1998 | Toyoda et al. | 445/24 |
| 5,779,514 | 7/1998 | Cheng et al. | 445/24 |

OTHER PUBLICATIONS

Journal of Vacuum Science & Technology B, Bozler, Carl O., Harris, Christopher T., Rabe, Steven, Rathman, Dennis D., Hollis, Mark A., and Smith, Henry I., "Arrays of gated field–emitter cones having 0.32 =μm tip–to–tip spacing", pp. 629–632, vol. 12, No. 2, Mar./Apr. 1994.

Journal of Vacuum Science & Technology B, Zhirnov, V. V., and Givargizov, E.I., "Chemical vapor deposition and plasma–enhanced chemical vapor deposition carbonization of silicon microtips", pp. 633–637, vol. 12, No. 2, Mar./Apr. 1994.

*Primary Examiner*—Kenneth J. Ramsey

*Attorney, Agent, or Firm*—Rose Alyssa Keagy; Richard L. Donaldson

[57] ABSTRACT

A method of fabricating electron emission structures 28 having enhanced emission characteristics. The method comprises the steps of providing a substrate 10 having electron emission structures 5 thereon and having a layer 5" over the electron emission structures. The layer 5" having apertures 30 in alignment with said electron emission structures 5. Then modifying the electron emission structures 5 through the apertures 30 with a directional ion milling beam; thereby creating modified electron emission structures 17,29 with enhanced emission efficiency.

5 Claims, 3 Drawing Sheets

SELF-ALIGNED METHOD OF MICRO-MACHINING FIELD EMISSION DISPLAY MICROTIPS

RELATED APPLICATIONS

This application includes subject matter which is related to U.S. patent application Ser. No. 08/768,724, "Method For Increasing Field Emission Tip Efficiency Through Micro-Milling Techniques," (Texas Instruments, Docket No. TI-23851), filed Dec. 18, 1996. This application also includes subject matter which is related to U.S. patent application Ser. No. 08/768,551, "Enhanced Field Emission Display Microtip Emissivity Structures," (Texas Instruments, Docket No. Tl-23852), filed Dec. 18, 1996, now U.S. Pat. No. 5,780,960.

TECHNICAL FIELD OF THE INVENTION

The present invention relates generally to the manufacture of flat panel displays and, more particularly, to a method for micro-machining the microtips to enhance their emission efficiency.

BACKGROUND OF THE INVENTION

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Patent No. 5,225,820, "Microtip Trichromatic Fluorescent Screen," issued 6 Jul. 1993, to Jean-Frédéric Clerc. These patents are incorporated by reference into the present application.

The Clerc ('820) patent discloses a trichromatic field emission flat panel display having a first substrate, on which are arranged a matrix of conductors. The first substrate is also called the cathode plate or the emitter plate. In one direction of the matrix, conductive columns comprising the cathode electrode support the microtips. In the other direction, above the column conductors, are perforated conductive rows comprising the grid electrode. The row and column conductors are separated by an insulating layer having apertures permitting the passage of the microtips, each intersection of a row and column corresponding to a pixel.

On a second substrate, facing the first, the display has regularly spaced, parallel conductive stripes comprising the anode electrode. The second substrate is also called the anode plate. These stripes are alternately covered by a first material luminescing in red, a second material luminescing in green, and a third material luminescing in blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

Referring initially to FIG. 1, there is shown, in cross-sectional view, a portion of an illustrative prior art field emission device in which the present invention may be incorporated. This device comprises an anode plate 1 having a cathodoluminescent phosphor coating 3 facing an emitter plate 2, the phosphor coating 3 being observed from the side opposite to its excitation.

More specifically, the field emission device of FIG. 1 comprises an anode plate 1 and an electron emitter (or cathode) plate 2. A cathode portion of emitter plate 2 includes conductors 9 formed on an insulating substrate 10, an electrically resistive layer 8 which is formed on substrate 10 and overlaying the conductors 9, and a multiplicity of electrically conductive microtips 5 formed on the resistive layer 8. In this example, the conductors 9 comprise a mesh structure, and microtip emitters 5 are configured as a matrix within the mesh spacings. Microtips 5 take the shape of cones which are formed within apertures through an electrically conductive layer 6 and an insulating layer 7.

A gate electrode comprises the layer of the electrically conductive material 6 which is deposited on the insulating layer 7. The thicknesses of gate electrode layer 6 and insulating layer 7 are chosen in such a way that the apex of each microtip 5 is substantially level with the electrically conductive gate electrode layer 6. Conductive layer 6 may be in the form of a continuous layer across the surface of substrate 10. Alternatively, as described in the Borel '161 patent, it may comprise conductive bands across the surface of substrate 10.

Anode plate 1 comprises a transparent, electrically conductive film 12 deposited on a transparent planar support 13, such as glass, which is positioned facing gate electrode 6 and parallel thereto, the conductive film 12 being deposited on the surface of the glass support 13 directly facing gate electrode 6. Conductive film 12 may be in the form of a continuous layer across the surface of the glass support 13; alternatively, it may be in the form of electrically isolated stripes comprising three series of parallel conductive bands across the surface of the glass support 13, as shown in FIG. 1 and as taught in U.S. Pat. No. 5,225,820, to Clerc. By way of example, a suitable material for use as conductive film 12 may be indium-tin-oxide (ITO), which is substantially optically transparent and electrically conductive. Anode plate 1 also comprises a cathodoluminescent phosphor coating 3, deposited over conductive film 12 so as to be directly facing and immediately adjacent gate electrode 6. In the Clerc patent, the conductive bands of each series are covered with a particulate phosphor coating which luminesces in one of the three primary colors, red, blue and green, labeled $\mathbf{3}_R$, $\mathbf{3}_B$, $\mathbf{3}_G$ respectfully.

Selected groupings of microtip emitters 5 of the above-described structure are energized by applying a negative potential to cathode electrode. 9 relative to the gate electrode 6, via voltage supply 15, thereby inducing an electric field which draws electrons from the apexes of microtips 5. The potential between cathode electrode 9 and gate electrode 6 is approximately 70–100 volts. The emitted electrons are accelerated toward the anode plate 1 which is positively biased by the application of a substantially larger positive voltage from voltage supply 11 coupled between the cathode electrode 9 and conductive film 12 functioning as the anode electrode. The potential between cathode electrode 9 and anode electrode 12 is approximately 300–1000 volts. Energy from the electrons attracted to the anode conductive film 12 is transferred to particles of the phosphor coating 3, resulting in luminescence. The electron charge is transferred from phosphor coating 3 to conductive film 12, completing the electrical circuit to voltage supply 11. Charge can also be transferred by secondary electron emission. The image created by the phosphor stripes is observed from the anode side which is opposite to the phosphor excitation, as indicated in FIG. 1.

The process of producing each frame of a display using a typical trichromatic field emission display includes (1) applying an accelerating potential to the red anode stripes while sequentially addressing the gate electrodes (row lines) with the corresponding red video data for that frame applied to the cathode electrodes (column lines); (2) switching the accelerating potential to the green anode stripes while sequentially addressing the rows lines for a second time with the corresponding green video data for that frame applied to the column lines; and (3) switching the accelerating potential to the blue anode stripes while sequentially addressing the row lines for a third time with the corresponding blue video data for that frame applied to the column lines. This process is repeated for each display frame.

It is to be noted and understood that true scaling information is not intended to be conveyed by the relative sizes and positioning of the elements of anode plate 1 and the elements of emitter plate 2 as depicted in FIG. 1. For example, in a typical FED shown in FIG. 1 there are approximately one hundred arrays 4, of microtips per display pixel, and there are three color stripes $\mathbf{3}^R$, $\mathbf{3}^B$, $\mathbf{3}^G$ per display pixel. Furthermore, phosphor coating 3 may not be a dense coating, but instead be comprised of an arrangement of phosphor particles which have adhered to conductors 12.

The conventional process for forming the microtips in the emitter plate of the flat panel display is taught by the Spindt et al. ('704) patent. This process involves forming a sacrificial layer, called a lift-off layer, on the surface of the gate using low angle evaporation techniques well known in the industry. The lift-off layer is illustratively nickel. The microtips are formed by evaporation, at a normal angle, of the tip metal into the holes formed in the gate metal and underlying insulator material. The tip metal is illustratively molybdenum. The superfluous tip metal located on top of the lift-off layer, and the lift-off layer are then dissolved by an electrochemical process which then exposes the gate metal and the microtips.

Many techniques have been proposed for enhancing microtip emission efficiency. Such techniques include 1) interferometric lithography, as described in *Journal of Vacuum Science & Technology B*, Bozler, Carl O., Harris, Christopher T., Rabe, Steven, Rathman, Dennis D., Hollis, Mark A., and Smith, Henry I., "Arrays of gated field-emitter cones having 0.32 $\mu$m tip-to-tip spacing," pp.629–632, Volume 12, Number 2, March/April 1994; 2) application of tip surface coatings, as described in *Journal of Vacuum Science & Technology B*, Zhirnov, V. V., and Givargizov, E. I., "Chemical vapor deposition and plasma-enhanced chemical vapor deposition carbonization of silicon microtips," pp.633–637, Volume 12, Number 2, March/April 1994; and 3) changing the shape of the electron emitter surface, as described in *Journal of Vacuum Science & Technology B*, Lee, Bo, Elliott, T. S., Mazumdar, T. K., Mcintyre, P. M., Pang, Y., and Trost, H. J., "Knife-edge thin film field emission cathodes on (110) silicon wafers," pp.644–647, Volume 12, Number 2, March/April 1994, and also described in *Journal of Vacuum Science & Technology B*, Pogemiller, J. E. Busta, H. H., and Zimmerman, B. J., "Gated chromium volcano emitters," pp.680–684, Volume 12, Number 2, March/April 1994, all incorporated herein by reference.

It is desirable to achieve the highest possible emission efficiency for field emission displays through enhancing microtip emission efficiency. However, there is a maximum microtip emission efficiency which can be achieved for each of the fabrication techniques taught in the articles listed above. There exists a need for a manufacturing technique which further increases the emission efficiency of any emission structure after its initial fabrication.

SUMMARY OF THE INVENTION

In accordance with the principles of the present invention, there is disclosed herein a method of fabricating electron emission structures having enhanced emission characteristics. The method comprising the steps of providing a substrate having electron emission structures thereon and having a layer over the electron emission structures. The layer having apertures in alignment with the electron emission structures. Then modifying the electron emission structures through the apertures with a directional ion milling beam; thereby creating modified electron emission structures having enhanced emission efficiency.

The methods disclosed herein for forming the enhanced emission microtips overcome limitations and disadvantages of the prior art display manufacturing methods. Specifically, this disclosed process can be used to modify microtips of any shape and material composition, thereby further improving the emission efficiency of those microtips. Also, the method disclosed uses the existing overburden material as a self-aligned mask during the microtip modification process, making the disclosed process very cost effective. Moreover, the advantageously described process for modifying the microtips is well understood, the microtips can be modified to realize enhanced emission efficiency without the time and expense of developing new manufacturing techniques.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
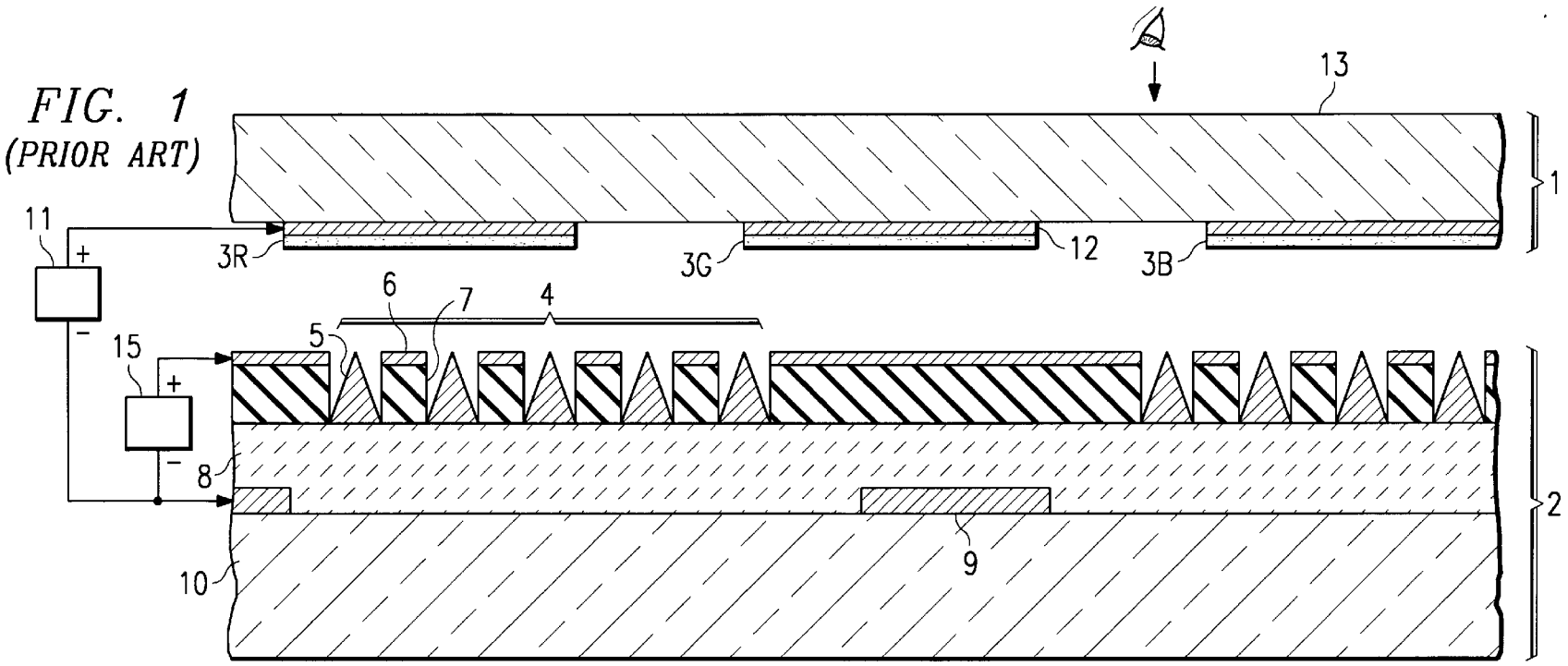
FIG. 1 (PRIOR ART)
FIG. 1 is a cross-sectional view of a portion of a prior art field emission flat panel display device.
Figure 2:
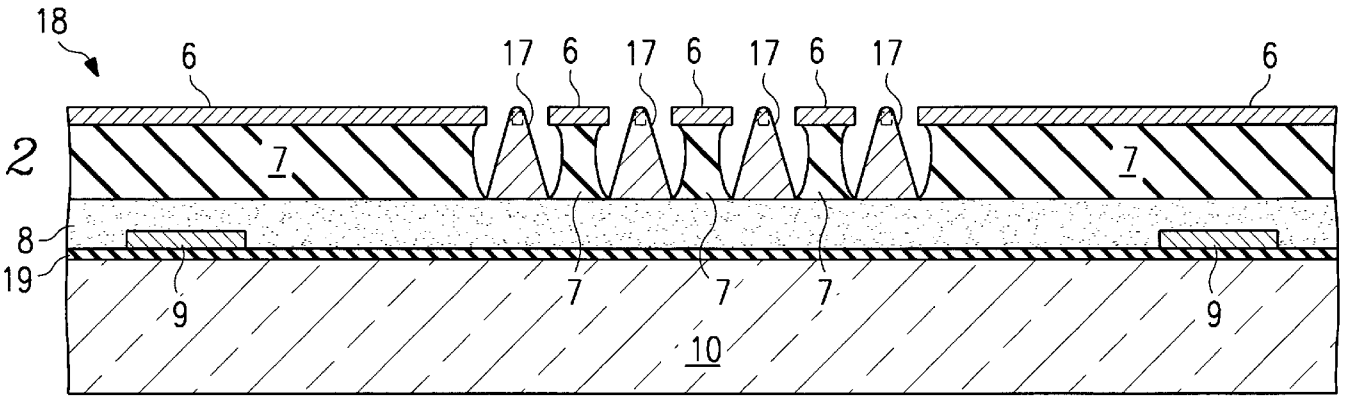
FIG. 2 is a cross-sectional view of a portion of an illustrative cathode plate fabricated in accordance with the present invention.

Referring initially to FIG. 2, there is shown, in cross-sectional view, a portion of an illustrative cathode plate fabricated in accordance with the present invention. It is to be noted and understood that true scaling information is not intended to be conveyed by the relative sizes and positioning of the elements. The illustrative cathode plate 18 of FIG. 2 includes many elements which are substantially identical to the elements of the prior art cathode plate 2 of FIG. 1. The elements of FIG. 2 which are substantially identical to the corresponding elements of the cathode plate 2 of FIG. 1 are numbered the same as the corresponding elements of FIG. 1.

The primary difference between cathode plate 18 of FIG. 2 and the cathode plate 2 of FIG. 1 is the structure of the microtips 17 of FIG. 2 versus the structure of the microtips 5 of FIG. 1. The structure of microtips 17 is discussed in more detail below. An optional thin insulating layer 19 is also shown in FIG. 2.

The method of fabricating an emitter plate for use in a field emission flat panel display device in accordance with the principles of the present invention comprises the following steps, considered in relation to FIGS. 3 through 9. The elements of FIGS. 3 through 9 which are numbered the same as elements of FIG. 2 are substantially identical to those elements of FIG. 2. The widths and thicknesses of the various layers and elements of FIGS. 3 through 9 are exaggerated and distorted, and no true scaling information should be perceived therefrom.

Figure 3:
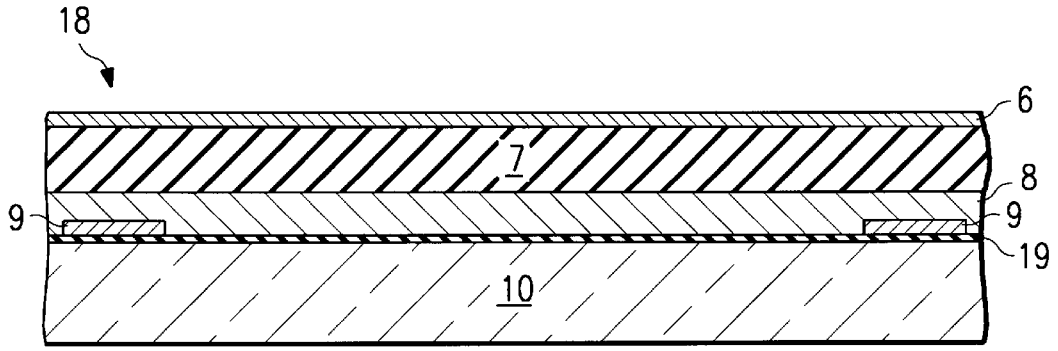
FIGS. 3 through 9 illustrate steps in a process for fabricating the cathode plate in accordance with the present invention.

The initial manufacturing steps of cathode plate 18 which follow are well known in the art (i.e. Spindt '704 and Meyer '780). Referring initially to FIG. 3, an insulating glass substrate 10 may first be coated with a thin insulating layer 19. Illustratively, the optional insulating layer 19 is $SiO_2$, which may be sputter deposited to a thickness of 50 nm. Conductive layer 9, which may typically comprise aluminum, molybdenum, chromium, or niobium, is deposited by either evaporation or sputtering over insulating layer 19 to a thickness of approximately 100–500 nm. A patterned mask and photoresist may then be used to form conductive layer 9 into a mesh structure as disclosed in the Meyer ('780) patent. Next, a resistive layer 8 is added by sputtering amorphous silicon over the cathode plate 18 to a thickness of approximately 500–2000 nm; alternatively the amorphous silicon may be deposited by a chemical vapor deposition process.

Next, insulating layer 7, which is illustratively $SiO_2$, is deposited by either a sputtered or a chemical vapor deposition technique over resistive layer 8 to a thickness of approximately 1.0 $\mu$. The gate electrode 6, which may typically comprise niobium, is then deposited by either evaporation or sputtering over insulating layer 7 to a thickness of approximately 0.2 to 0.4 $\mu$.

Figure 4:
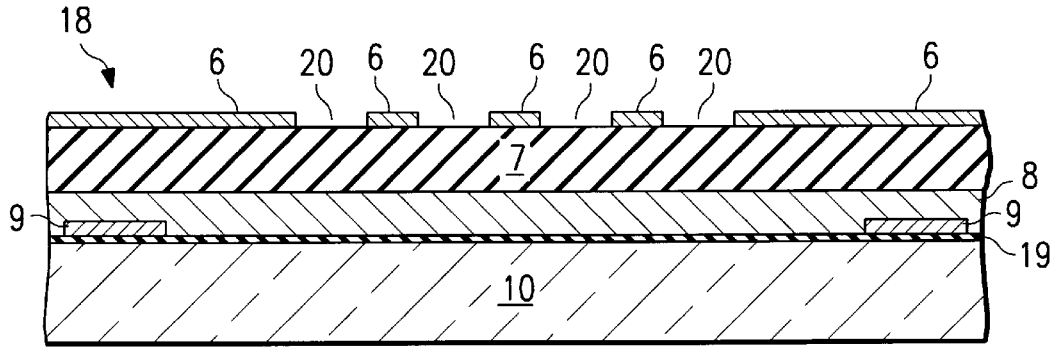

The Borel et al. ('161) patent discloses an etching process for creating the apertures in the gate electrode material coating 6 and the insulating layer 7. The described process includes a reactive ion etching of conductive coating 6 using a sulfur hexafluoride ($SF_6$) plasma to form apertures 20. The result, as shown in FIG. 4 is illustratively n×m (i.e. 4×4) apertures 20, at 3$\mu$ aperture pitches and 25$\mu$ aperture array pitches. The Borel et al. ('161) patent specifies that holes 20 made in the conductive coating 6 should have a diameter of 1.3±0.1$\mu$.The diameter of hole 20 through conductive coating 6 is important because it affects the final form of the microtip 17.

Figure 5:
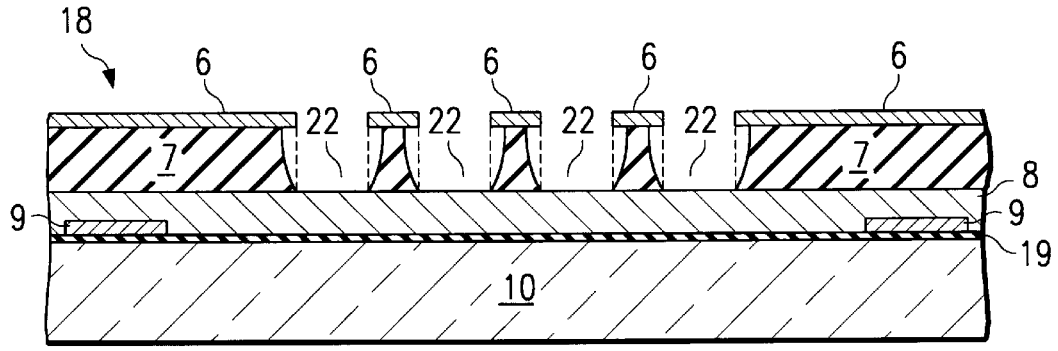

The reactive ion etching of conductive coating 6 also etches insulating layer 7, as indicated by the dashed lines in FIG. 5. Next, the insulating layer 7 is undercut by chemical etching, e.g., by immersing the structure in a hydrofluoric acid and ammonium fluoride etching solution. As shown in FIG. 5, this process results in a plurality of arrays of cavities 22 in respective concentric alignment with, and located beneath, the former apertures 20.

Figure 6:
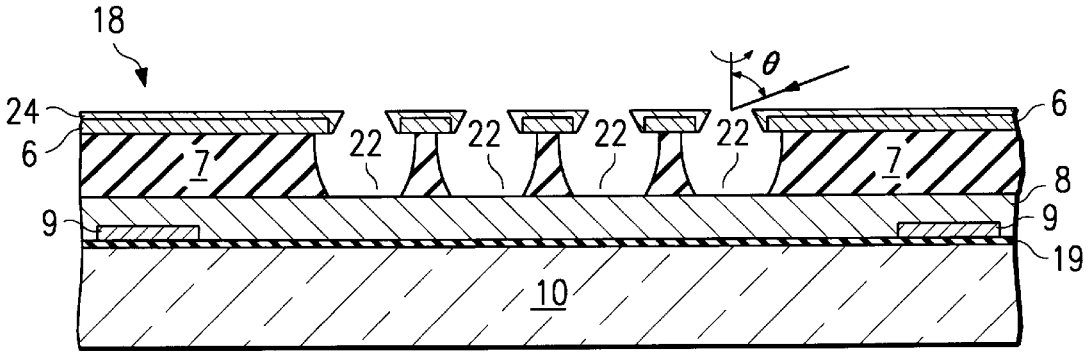

As shown in FIG. 6, a sacrificial lift-off layer 24 is formed by electron beam deposition over conductive coating 6 while rotating the substrate 10. The electron beam is directed at an angle of 5°–20° to the cathode plate surface (70°–85° from normal) in order to also coat the circumferential aperture walls with lift-off material. The result of the plating process is a lift-off layer 24 which covers all exposed surfaces of the gate electrode 6, as shown in FIG. 6. The lift-off layer 24 is illustratively nickel, deposited to a thickness of 150 nm.

Figure 7:
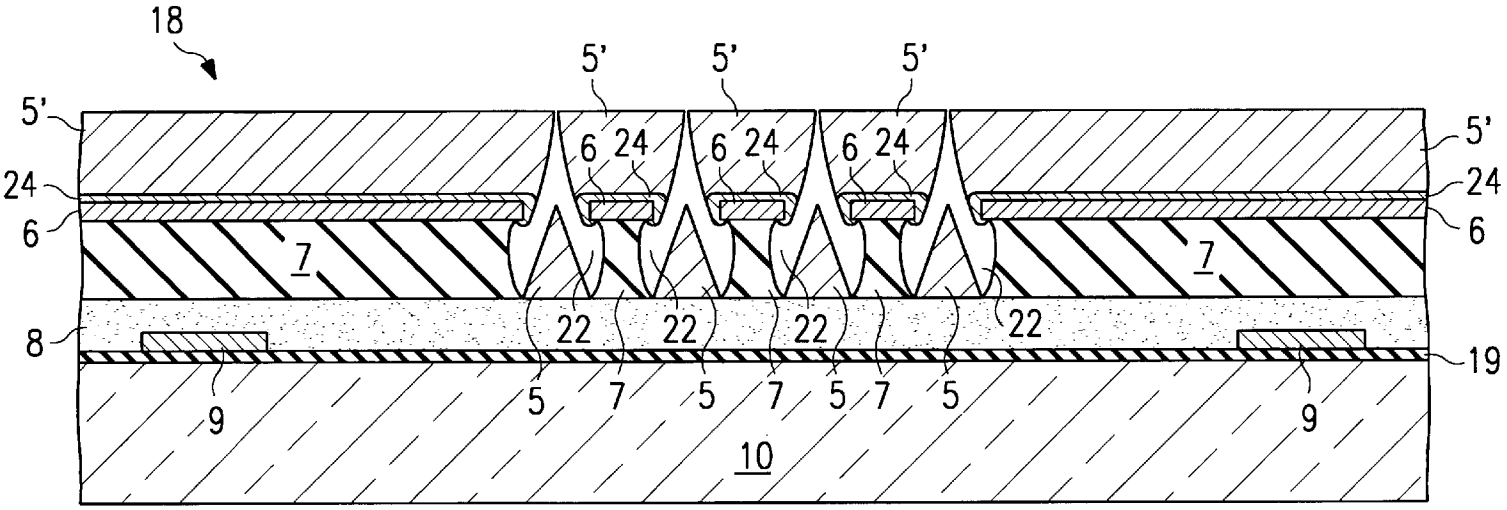

The next step in the manufacture of the emitter plate 18 is the formation of the microtip emitters 5, which may be as described in the Borel et al. ('161) patent. As shown in FIG. 7, the cone-shaped microtips 5 are deposited inside each cavity 22 by the deposition of a material coating, such as molybdenum, on the complete emitter structure 18 at a normal to slightly off-normal incidence. The result is the formation of pluralities of arrays of n×m microtips 5, which are in concentric alignment with the n×m apertures 22 of each aperture array. During the deposition process, the opening to aperture 22 narrows as the molybdenum coating simultaneously forms both the microtips 5 and the lift-off overburden 5'. The thickness of the microtips 5 is approximately 1.5$\mu$. The lift-off overburden 5" is approximately 2.0$\mu$.

Alternatively, the microtip structures may be shaped as triangular or "knife-edged" structures. The above-mentioned article "Knife-edge thin film field emission cathodes on (110) silicon wafers," describes these structures and method of fabrication.

Figure 8:
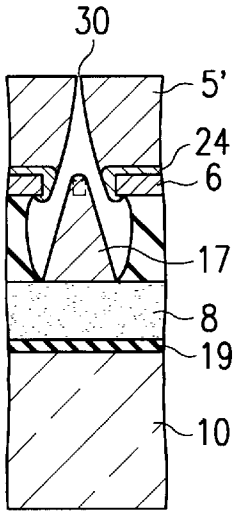

In accordance with the present invention, the cathode plate 18 is put through a self-aligned blanket etch process. More specifically, in a technique commonly known in the art, the cathode plate 18 is bombarded with a highly directional ion milling beam. The directional milling beam may comprise neutral ions, such as argon. Alternatively, the directional ion milling beam may comprise chemically reactive ions,. such as Reactive Ion Etch (RIE). The directional ion milling beam is directed toward cathode plate 18 substantially normal to the cathode plate 18. During this process the small hole, or aperture, 30 left in the previously formed overburden 5" functions as a self-aligned mask, directing the atoms to strike, within a narrow radius, the point of the microtips 5. The "volcano" structure 17 resulting from the blanket etch of a conical microtip is shown in FIG. 8. The "double knife-edge" structure 29 resulting from the blanket etch of the knife-edge microtip is shown in FIG. 9.

Figure 9:
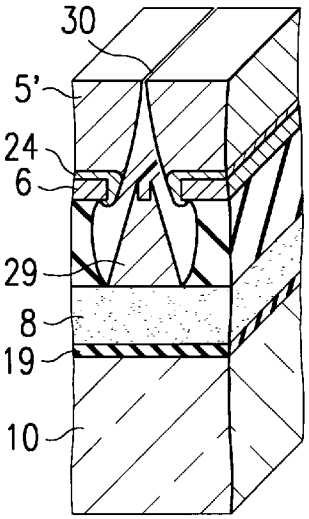

The dimensions of the various elements of FIGS. 8 and 9 are exaggerated and distorted in order to more clearly describe the invention; no true scaling information should be perceived therefrom. For example, the cuts made during the directional ion milling process are shallow. Specifically, the cuts are made such that the apex of the microtip does not fall substantially below the plane of the gate electrode 6 after the above described microtip modification process. It is important that the top of the modified microtips remain in the plane of the gate electrode 6 because the electric field is greatest at the gate electrode 6. The highest possible electron emissions are realized when the apex of the microtip, which is the portion of the microtip where most of the electron emission occurs, is in the plane of the gate electrode 6.

The sacrificial lift-off layer 24 is now dissolved by electrolytic etching. During the dissolution of the lift-off layer 24 the superfluous tip metal overburden 5" is also released, thereby creating the final cathode structure.

Several other variations in the above processes, such as would be understood by one skilled in the art to which it pertains, are considered to be within the scope of the present invention. First, a hard mask, such as aluminum or gold, may replace the photoresist layers of the above described process. Next, more than one material my be evaporated to form the microtips. Also, the microtips may be comprised of other materials or combinations of materials, such as niobium coated with any low work function material. In addition, the lift-off layer and overburden material may be removed by other procedures well known in the art, such as sonic bath, water spray, or air gun. Furthermore, overburden material which is shaped different than that described above can be used to create emitter structures of additional shapes.

The methods disclosed herein for forming the enhanced emission microtips overcome limitations and disadvantages of the prior art display manufacturing methods. Specifically, this disclosed process can be used to modify microtips of any shape and material composition, thereby further improving the emission efficiency of those microtips. Also, the method disclosed uses the existing overburden material as a self-aligned mask during the microtip modification process, making the disclosed process very cost effective. Moreover, the advantageously described process for modifying the microtips is well understood, the microtips can be modified to realize enhanced emission efficiency without the time and expense of developing new manufacturing techniques.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

It is claimed:

1. A method of fabricating electron emission structures having enhanced emission characteristics comprising the steps of:

providing a substrate having electron emission structures thereon and having a layer over said electron emission structures, said layer having apertures in alignment with said electron emission structures; and modifying said electron emission structures through said apertures with a directional ion milling beam.

2. The method in accordance with claim 1 wherein said directional ion milling beam comprises an inert gas.

3. The method in accordance with claim 1 wherein said directional ion milling beam comprises ions which chemically react with the material of said electron emission structures.

4. The method in accordance with claim 1 wherein said electron emission structures are conical and wherein said modifying step forms craters in said conical electron emission structures.

5. The method in accordance with claim 1 wherein said electron emission structures are elongated wedges and wherein said modifying step forms a channel in said elongated wedge electron emission structures.

* * * * *